United States Patent [19]

Daley, Jr.

[11] 4,038,800

[45] Aug. 2, 1977

[54] ADJUSTABLE GRILLS FOR USE AS DOORS, WINDOWS, GATES OR THE LIKE

[76] Inventor: Richard John Daley, Jr., Rte. 2, Box 86B, Alexandria, La. 71301

[21] Appl. No.: 714,619

[22] Filed: Aug. 16, 1976

[51] Int. Cl.[2] ..... E06B 3/68

[52] U.S. Cl. ..... 52/507; 49/55; 52/509; 52/632; 52/645

[58] Field of Search ..... 52/645, 509, 455, 510, 52/456, 632, 507, 656, 665, 37, 106; 49/50, 55, 61

[56] References Cited

U.S. PATENT DOCUMENTS

| | | | |
|---|---|---|---|
| 168,630 | 10/1875 | Fleming | 49/55 X |
| 683,217 | 9/1901 | Mower | 49/55 |
| 1,715,208 | 5/1929 | Micklin | 52/507 |
| 1,788,928 | 1/1931 | Mills | 49/50 |
| 2,546,676 | 3/1951 | North | 52/632 X |
| 2,620,526 | 12/1952 | Stukenborg | 49/55 |
| 2,668,729 | 2/1954 | Watters | 49/50 |
| 3,738,062 | 6/1973 | Ughi | 49/55 |

FOREIGN PATENT DOCUMENTS

| | | | |
|---|---|---|---|
| 259,205 | 1/1968 | Austria | 52/665 |
| 471,248 | 2/1951 | Canada | 52/632 |

*Primary Examiner*—Leslie Braun
*Attorney, Agent, or Firm*—L. A. Proctor

[57] ABSTRACT

Apparatus constituting a grill for use as a gate, door, window or the like, adjustable for fitting upon a frame to cover an opening. The grill is comprised of a pair of frames, a first of which is constituted of vertical and horizontal members inclusive of an inner vertically oriented channel member within which is affixed a plurality of spaced apart ring-like sections of metal through which a locking bar can be passed, and a second of which is constituted of vertical and horizontal members inclusive of an inner vertically oriented member containing a plurality of spaced apart internally threaded openings, and the frames constituting the grill are held together by a plurality of horizontally oriented rods, an end of each of which is externally threaded for threadable engagement with said internally threaded spaced apart openings located on the inner vertical member of said second frame, and the opposite ends are provided with eyes through which they can be engaged to the channel member of said first frame by passage of said locking bar therethrough. After the grill has been properly sized to an opening it can be secured in place upon the frame by a relatively unskilled workman with ordinary household tools.

7 Claims, 8 Drawing Figures

ADJUSTABLE GRILLS FOR USE AS DOORS, WINDOWS, GATES OR THE LIKE

Gateways, doorways and windows have been known as important architectural elements for thousands of years. From early doors constituted of hides or textiles, gateways, doorways and windows evolved with the early Egyptians as matting which could be rolled up and lowered. These architectural elements as rigid, permanent materials appeared simultaneously with monumental architecture. The most important gates and doors were constructed of stone or metal, generally bronze, though the most common were constructed of wood. Windows have followed a parallel evolution.

Metal or metal clad gates and doors of bronze, iron, steel and aluminum were commonly used in the mid-nineteenth century, and from this time on innovations have been made in hanging various styles of gates and doors. Windows, generally speaking, have been similarly constructed but differ from gates and doors in that the use of windows essentially always requires greater emphasis in the admission of light or air into an abode or residence. Yet all are mounted to swing, fold, slide, roll, or even revolve in order to close an entrance or opening, e.g., an archway such as opens to a patio, room or building. These architectural elements provide a number of functions, without doubt the most important of which is to assure privacy and to keep out intruders, often those who would criminally enter onto another's property, or into another's residence or place of business. Gates, doors, and windows differ greatly in their complexity, in their ease of construction and hanging, and in their installation, which functions generally require skilled craftsmen with special tools. There is a particular need for such architectural elements which can be prefabricated of durable materials by skilled craftsmen at a manufacturing site, and later adjustably fitted over openings and permanently installed by relatively unskilled persons with common household tools.

Accordingly, it is a prime object of the present invention to supply this need.

A particular object is to supply a metallic grill structure which can be adjusted to fit a frame or opening, and thereafter permanently secured upon or within the frame or opening by a relatively unskilled person with ordinary household tools.

A more specific object is to provide a grill of such character which can be structured in a variety of sizes and shapes, at relatively low cost, for use as a gate, door or window.

These and other objects are achieved in accordance with the present invention, constituting a gate, door, window or the like, i.e., a grill, which is adjustable for fitting or setting within a frame to cover an opening, and which thereafter can be permanently secured with the frame by a relatively unskilled workman with ordinary household tools. The grill is comprised of a pair of frames, a first of which is constituted of vertical and horizontal members inclusive of an inner vertically oriented channel member within which is affixed a plurality of spaced apart ring-like sections of metal through which a locking bar can be passed, and a second of which is constituted of vertical and horizontal members inclusive of an inner vertically oriented member containing a plurality of spaced apart internally threaded openings, and the frames constituting the grid are held together by a plurality of horizontally oriented rods, an end of each of which is externally threaded for threadable engagement with said internally threaded spaced apart openings located on the inner vertical member of said second frame, and the opposite ends are provided with eyes through which they can be engaged to the channel member of said first frame by passage of said locking bar therethrough.

These and other features and advantages will be better understood by reference to the following detailed description, and to the accompanying drawings to which reference is made in the description. Similar numbers are used in the drawings to identify similar parts and components in the different figures, and subscripts are used to designate a plurality of analogous parts or components. Where subscripts are used in the general discussion, subsequent to their introduction and the parts thereafter referred to without reference to the subscripts, the designations are intended to apply in the generic sense. Referring to the drawings:

Figure 1:
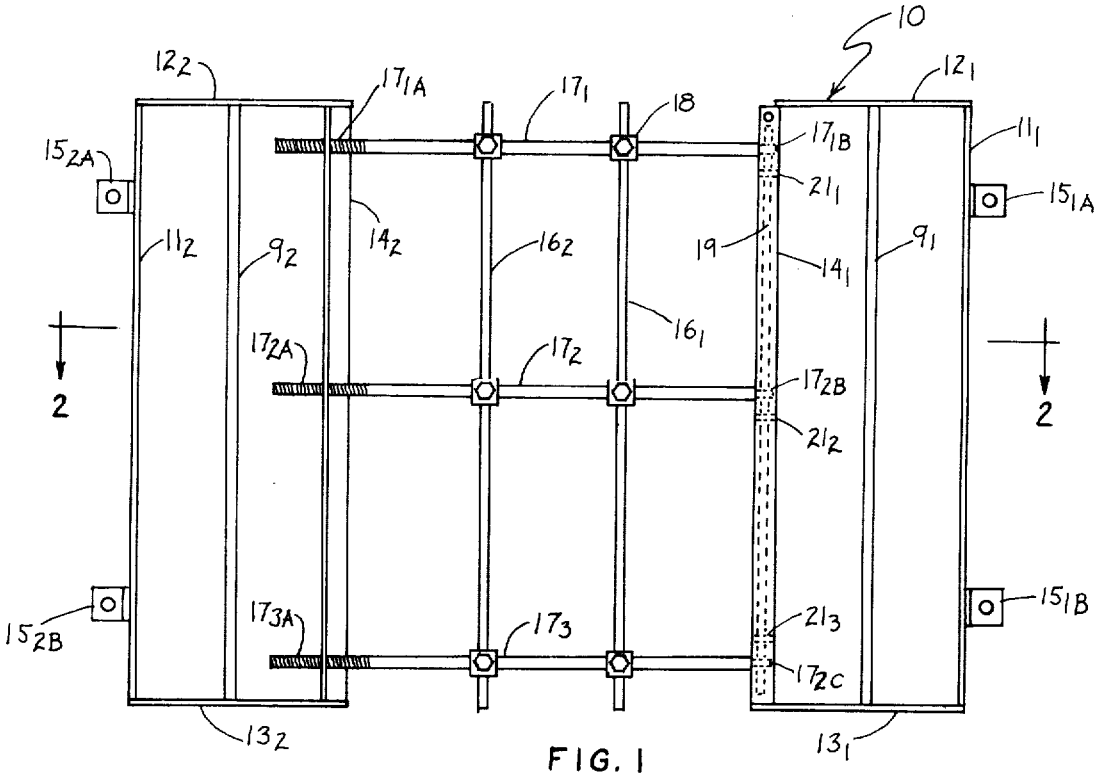
FIG. 1 depicts a front view of a preferred type of window grill, adjustable for fitting within or upon a frame (not shown) to cover an opening.
Figure 2:
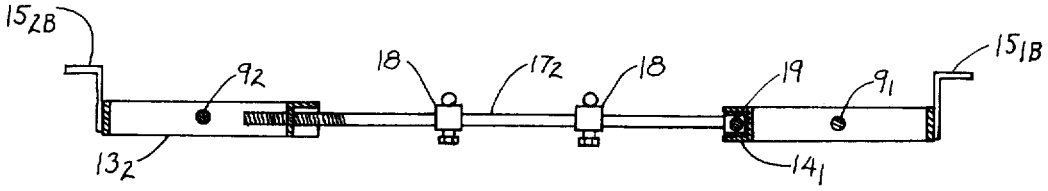
FIG. 2 is a sectional view taken along line 2-2 or the preceding figure.

Referring to FIGS. 1 and 2 there is shown generally a preferred type of metallic window grill 10, of adjustable size, comprised of two frames of parallelogram shape, a first frame constituted of vertical members $\mathbf{9_1,11_1,14_1}$ and horizontal members $\mathbf{12_1,13_1}$ and a second frame constituted of vertical members $\mathbf{9_2,11_2,14_2}$ and horizontal members $\mathbf{12_2,13_2}$, the two frames being held together in adjustable relationship via horizontal rods $\mathbf{17_1,17_2,17_3}$. The function of the vertical rods $\mathbf{9_1,9_2}$ of the two frames is for structural strength, and to restrict access. Obviously, one or a plurality of such rods could be used for construction of these frames, and horizontal components could be substituted therefor or added, as desired. The member $\mathbf{14_1}$ is suitably of channel construction, and provided with a plurality of spaced apart, open centered metal sections $\mathbf{21_1,21_2,21_3}$, permanently affixed therein, as by welding, through which a bar 19 can be passed. In this regard, it will be observed that one end of each of horizontal bars $\mathbf{17_1,17_2,17_3}$ is open ended, or provided with an eye and can be pinned to the frame comprised of members $\mathbf{9_1,11_1,12_1,13_1,14_1}$ by passage of bar 19 therethrough. The second frame comprised of members $\mathbf{9_2,11_2,12_2,13_2,14_2}$ is retained as part of the unitary structure by threadable connection between members $\mathbf{17_1,17_2,17_3}$ and the channel or angle iron member $\mathbf{14_2}$, the former being joined to the latter via external threads$\mathbf{17_{1A},17_{2A},17_{3A}}$ which mate with internal threads located in openings through member $14_2$. The vertical bars $16_1$,$16_2$, held in place by lock nuts or retainer members 18, are employed for structural strength, and to restrict access. The brackets $15_{1A}$,$15_{1B}$,$15_{2A}$,$15_{2B}$ provide means for hanging the adjusted structure in place upon a frame for covering an opening.

Figure 3:
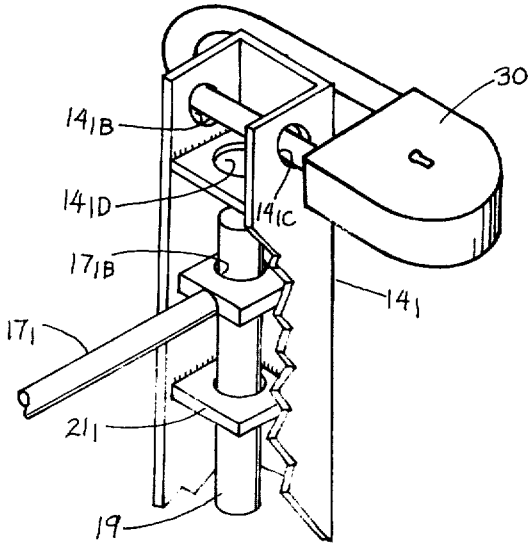
FIG. 3 is an isometric fragmentary view of a portion of the window grill of the preceding figures, showing one technique by which the grill can be permanently installed after it is fitted within or upon a frame.

Horizontal adjustment of the window grill 10, as will be apparent, is accomplished in initial assembly by screwing the threaded ends $17_{1A}$,$17_{2A}$,$17_{3A}$ of members 17 into channel $14_2$ to provide a preselected total grill width, after which step the ends of members 17 are pinned within channel 19 via use of the bar 19. This done, as shown by reference to FIG. 3, the bar 19 can be permanently secured in place by use of a lock 30 which is passed through the openings $14_{1B}$,$14_{1C}$ and locked. Whereas a rivet can be passed through such openings $14_{1B}$,$14_{1C}$, or the bar 19 can then be welded in place, the lock eliminates entirely any need for certain types of tools or materials. For epicurian reasons, the excessive lengths of the threaded ends $17_{1A}$,$17_{2A}$,$17_{3A}$ of members 17 can be removed by sawing, as with a hacksaw, if desired.

Figure 5:
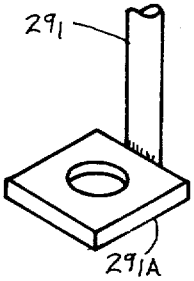
FIG. 5 is a fragmentary isometric view of a portion of the mechanism described by reference to FIG. 4.
Figure 4:
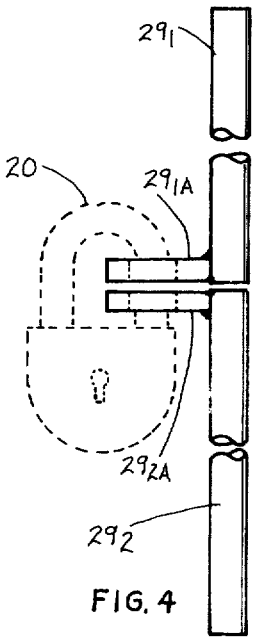
FIG. 4 is a fragmentary view of a preferred mechanism for making the installation permanent after the device of FIGS. 1-3 is installed within or upon a frame.

Referring to FIGS. 4 and 5, the bar 19 can, if desired, be substituted by a bar pair $29_1$,$29_2$. The bar pair $29_1$,$29_2$ can also be locked in place as via the use of a lock 20 which is passed through openings $29_{1A}$,$29_{2A}$ to retain these members in place after passage through the open ends of members $17_1$,$17_2$,$17_3$.

Figure 6:
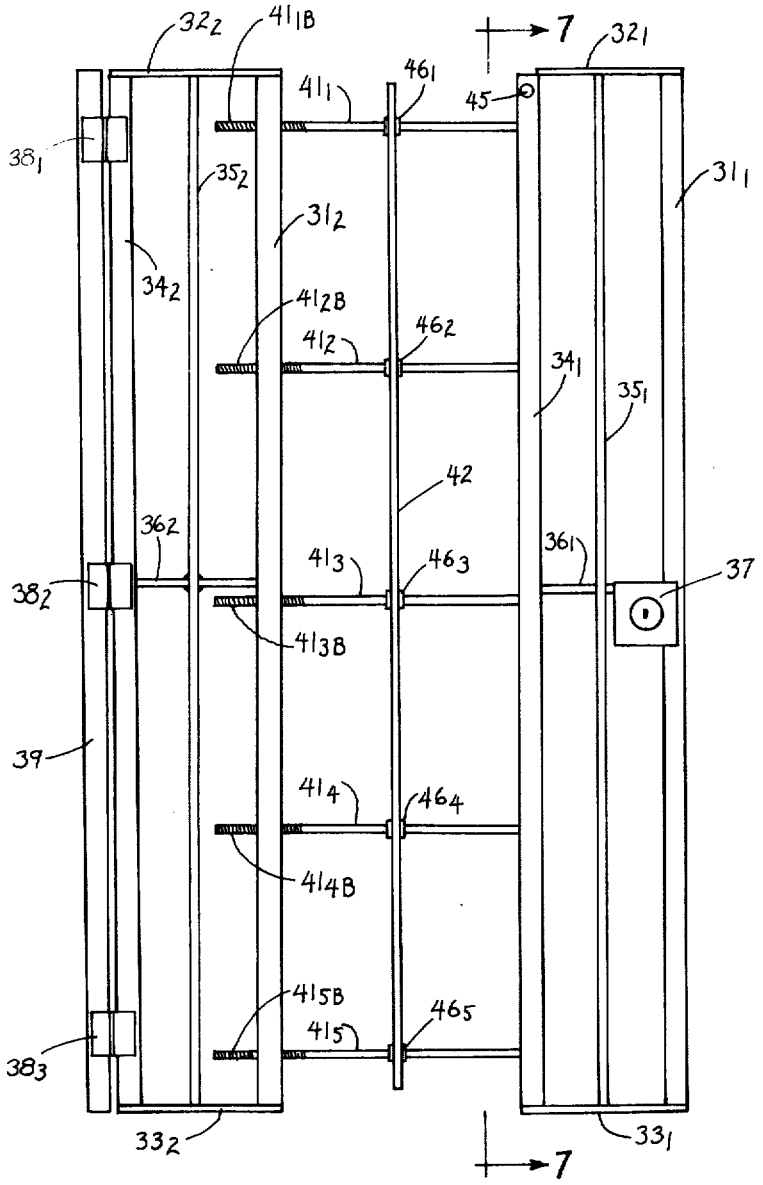
FIG. 6 depicts a front view of a preferred type of grill for use as a door, or gate, adjustable for fitting within or upon a frame (not shown) for covering an opening.
Figure 7:
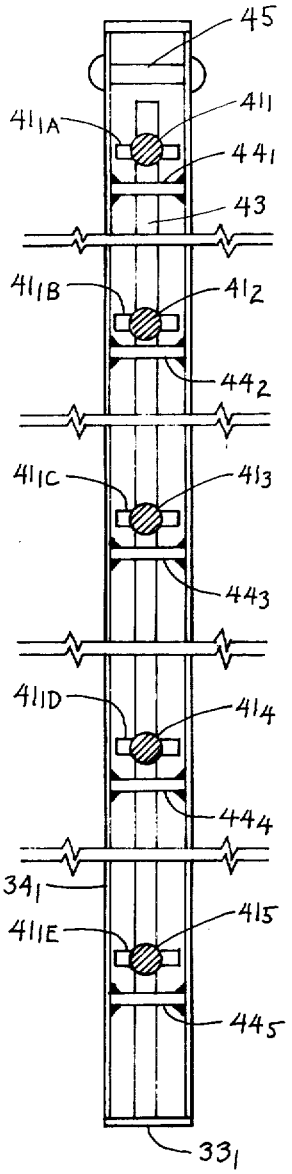
FIG. 7 is a sectional view taken along line 7-7 of FIG. 6.

Referring to FIGS. 6 and 7 there is shown generally a preferred type of grill suitable as a metallic door, of character essentially as described by reference to the preceding figures. The door is thus similarly constituted of two parallelogram shaped frames, a first frame constituted of vertical members $31_1$,$34_1$,$35_1$ and horizontal members $32_1$,$33_1$,$36_1$ and a second frame constituted of vertical members $31_2$,$34_2$,$35_2$ and horizontal members $32_2$,$33_2$,$36_2$ held together in adjustable relationship via horizontal rods $14_1$,$41_2$,$41_3$,$41_4$,$41_5$. The rods 41 are each threaded at an end $41_{1B}$,$41_{2B}$,$41_{3B}$,$41_{4B}$,$41_{5b}$ for adjustment of the total width of the door by screwing the rods 41 as deeply as desired within the channel member $31_2$ after which time, if desired, the excess length can be reduced by sawing off portions of the threaded ends of the rods 41. After the width is set for the dimension desired, the opposite open end of the rods 41 are retained within the channel $34_1$ via vertical passage of a rod 43 through the eye portions $41_{1A}$,$41_{1B}$,$41_{1C}$,$41_{1D}$,$41_{1E}$. Thereafter, the rod 43 can be retained in place, e.g., via a rivet 45, as shown, or welded, or locked as in the device described by reference to FIGS. 1-3.

Figure 8:
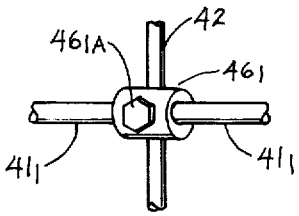
FIG. 8 is an isometric fragmentary view of a structural element used for fitting the grill in place and for making the installation permanent.

A conventional lock 37, operable by use of a key, is generally provided for permanent use after the door is hanged as by mounting the member 39 in place on a door frame, the door being mounted on member 39 via hinges $38_1$,$38_2$,$38_3$. The rod 42, or a plurality thereof (not shown) is provided for additional strength, to limit access, and is secured in place on the rods 41 via a number of retaining members, or lock nuts 46. For example, lock nut $46_1$ (FIG. 8) is of tubular design and affixed upon rod 42 as by welding, and rod 41 is passed through the tubular portion of the lock nut and retained in place by tightening down on bolt $46_{1A}$ can be sheared off after the door is permanently mounted.

It is apparent that various modifications and changes can be made, e.g., as in the size, shape and materials of construction, without departing the spirit and scope of the invention.

Having described the invention, what is claimed is:

1. Apparatus constituting a grill for use as a gate, door, window or the like adjustably is fitting upon a frame to cover an opening, and which thereafter is permanently secured upon the frame by a relatively unskilled workman with ordinary household tools, which comprises a locking bar, a pair of flat, substantially parallelogram shaped frames constituted of vertical and horizontal members, a first frame which includes an inward vertically oriented channel member of length substantially equal to the length of the inward side of said frame and within which is mounted a plurality of spaced apart, open centered metal sections, through which the locking bar is passed, and a second frame which includes an inward vertically oriented member provided with a plurality of spaced apart internally threaded openings, a plurality of horizontally oriented rods, one end of each of which is externally threaded and is in threadable engagement with said spaced apart internally threaded openings of said second frame, and the opposite end of each of which is provided with an eye through which said locking bar is passed to lock the horizontally oriented rods in place within the channel member of said first frame, after the horizontally oriented rods have been screwed into said spaced apart internally threaded openings of said second frame to provide the desired total width.

2. The apparatus of claim 1 wherein the structure additionally includes one or more vertically oriented rods affixed upon the horizontally oriented rods to increase the strength of the structure, and to limit access.

3. The apparatus of claim 2 wherein the additional vertically oriented rods are secured to the horizontally oriented rods via a lock nut of tubular design which is physically affixed to one member, and another is passed through the tubular opening and locked in place by tightening down on a screw.

4. The apparatus of claim 1 wherein the channel member of the first frame includes an opening with the top thereof through which a lock can be inserted to retain the locking bar in place.

5. The apparatus of claim 4 wherein the locking bar is comprised of two sections, each having an eye at a terminal end thereof within which a lock can be inserted to retain the locking bar in place.

6. The apparatus of claim 1 wherein the two frames which form the grill are of height lesser than the width of the total structure, and each frame is provided with two or more brackets on outer vertical members for covering an opening such as a window.

7. The apparatus of claim 1 wherein the two frames which form the grill are of height greater than the width of the total structure, and the outer edge of one of the vertical members is hinged to a post which can be attached to a frame to cover an opening to provide a door or gate.

* * * * *